United States Patent [19]

Humphrey et al.

[11] Patent Number: 4,811,000

[45] Date of Patent: Mar. 7, 1989

[54] ARTICLE ENCLOSURE WITH MAGNETIC MARKER DEACTIVATING MEANS

[75] Inventors: Floyd Humphrey, Meredith Neck, N.H.; James B. Cantey, Fort Lauderdale, Fla.

[73] Assignee: Sensormatic Electronics Corporation, Deerfield Beach, Fla.

[21] Appl. No.: 163,954

[22] Filed: Mar. 3, 1988

[51] Int. Cl.[4] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 4,075,618 | 2/1978 | Montean | 340/572 |
| 4,665,387 | 4/1987 | Cooper et al. | 340/572 |
| 4,673,923 | 6/1987 | Boscoe et al. | 340/572 |
| 4,689,590 | 8/1987 | Heltemes | 340/572 |
| 4,692,746 | 9/1987 | Budin et al. | 340/572 |

*Primary Examiner*—Glen R. Swann, III

*Attorney, Agent, or Firm*—Robin, Blecker & Daley

[57] ABSTRACT

An enclosure for receiving and carrying an article provided with a magnetic marker wherein the enclosure includes magnetic means for deactivating the marker when the article is housed within the enclosure.

19 Claims, 2 Drawing Sheets

ARTICLE ENCLOSURE WITH MAGNETIC MARKER DEACTIVATING MEANS

BACKGROUND OF THE INVENTION

This invention relates to electronic article surveillance systems wherein the articles are provided with magnetic markers for detection of the articles and, in particular, to methods and apparatus for deactivating the magnetic markers of such systems.

Article surveillance systems are well known in the art wherein articles are provided with magnetic markers which enable the detection of unauthorized passage of the articles through an interrogation zone. In these systems, a magnetic field is established in the interrogation zone and the magnetic marker attached to an article causes a perturbation to the field when the article is in the zone. This perturbation is detected by a receiving system which activates an alarm to indicate the presence of the article.

In some systems of this type, provision is made for deactivating the marker so the article can pass through the interrogation zone without generating an alarm. Thus, for example, where passage is authorized, as where the article has been paid for, the marker would be deactivated so as to permit uninhibited passage of the article through the zone.

One way of providing the desired deactivation is to utilize in the magnetic marker adjacent strips of so-called "soft" and "hard" magnetic materials such as, for example permalloy and vicalloy, respectively. In a marker of this type, the permalloy, which has a high permeability, low coercive force and is easily saturable, would normally provide a perturbation to the field in the interrogation zone resulting in an alarm condition when an article carrying the marker passes through the zone. However, if the article is first subjected to a high magnetic field prior to reaching the interrogation zone, such as at an article check out area, this high field causes the hard material to become permanently magnetized. As a result, when the article is taken through the interrogation zone, the magnetized hard material prevents the soft material from perturbing the field in a way recognizable by the surveillance system. The article thus passes without alarming the system. Deactivating of a magnetic marker in this manner is taught, for example, in U.S. Pat. No. 3,747,086.

As above-indicated, the above-discussed deactivation procedure relies on subjecting the article carrying the marker to a high magnetic field in order to magnetize the hard magnetic material. However, use of such a high field is undesirable in applications where the articles themselves are magnetically sensitive such as, for example, magnetic tapes which are normally housed in cassettes. In such situations, the application of a high magnetic field to deactivate the marker may likely extend into the cassette and damage information on the magnetic tape.

In U.S. Pat. No. 4,665,387 there is disclosed a deactivation apparatus which attempts to avoid the necessity of having to use a high magnetic field to achieve deactivation. In this apparatus, a deactivation assembly is provided with a thin strip of hard magnetic material which is permanently magnetized along its length so that adjacent magnetized sections are of opposite magnetic polarization. The assembly is further configured so that when an article to be deactivated is brought into the assembly its magnetic marker comes to rest in close proximity to the permanently magnetized strip. This causes the hard magnetic material of the marker to become permanently magnetized with the pattern of magnetization of the strip. As a result, the soft magnetic material of the marker and, therefore, the marker itself, is rendered unable to activate its associated surveillance system.

While the apparatus of the '387 patent thus avoids the use of an uncontrolled, high deactivation field, it requires a separate deactivation assembly with its attendant expense.

Also, once the marker used with the '387 apparatus is deactivated, it must be reactivated if it is to be used again. This requires a further reactivation assembly and further added expense. Also, in the case where the article is a magnetic tape, reactivation significantly increases the risk of damaging the tape through inadvertent misuse of the reactivation assembly.

It is, therefore, a primary object of the present invention to provide a deactivation practice for a magnetic marker which avoids the need for high magnetic fields and a special deactivation assembly.

It is a further object of the present invention to provide deactivation practice which also avoids the need for a reactivation assembly.

It is yet a further object of the present invention to provide deactivation practice which can be safely used with articles carrying magnetic materials such as magnetic tape cassettes.

SUMMARY OF THE INVENTION

In accordance with the principles of the present invention, the above and other objectives are realized by incorporating into the enclosure means used to receive and carry an article, magnetic means for deactivating the magnetic marker carried by the article. Thus, when an article is authorized to be carried from a location, placement within its associated carrying enclosure brings the magnetic marker of the article adjacent the deactivating magnetic means of the enclosure. The marker is thereby deactivated and the article allowed to pass without alarming the associated surveillance system.

In the present illustrative form of the invention, the magnetic means comprises a hard magnetic material which is permanently magnetized to have adjacent magnetized sections of opposite magnetic polarization along its length. Furthermore, the magnetic marker used contains exclusively a soft magnetic material so that the marker is only deactivated when in the deactivating enclosure and subsequent removal reactivates the marker. In the disclosed embodiment, the article is a video tape cassette and the enclosure is a case for carrying the video cassette.

BRIEF DESCRIPTION OF THE DRAWINGS

The above and other features and aspects of the present invention will become more apparent upon reading the following detailed description in conjunction with the attached drawings, in which.

DETAILED DESCRIPTION

Figure 1:
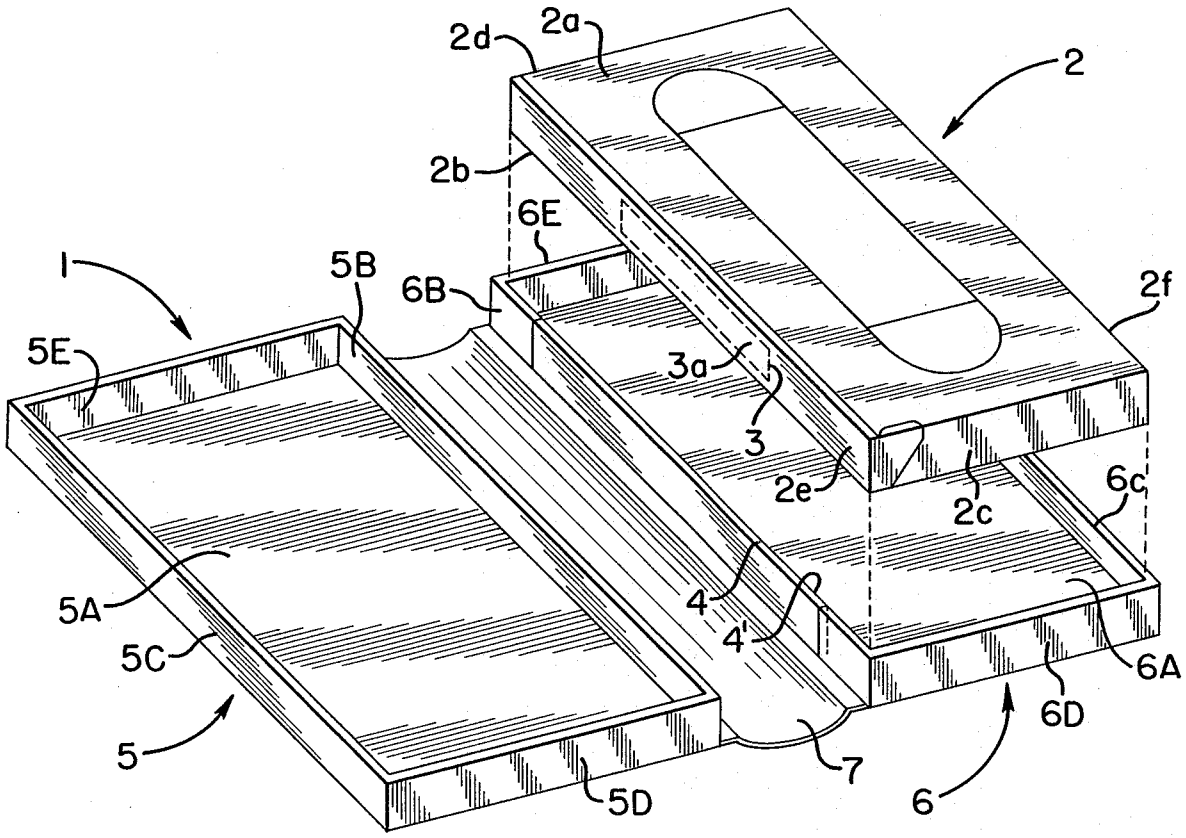
FIG. 1 illustrates an article enclosure in accordance with the principles of the present invention.

In FIG. 1, an enclosure 1 in accordance with the principles of the present invention is shown. In the present illustrative situation, the enclosure 1 is a case for receiving and carrying an article 2 in the form of a video magnetic tape cassette.

As shown, the article 2 comprises upper and lower walls 2*a* and 2*b*, side walls 2*c* and 2*d* and front and back walls 2*e* and 2*f*. The front wall 2*e* of the article is pivotably mounted to permit access to the video tape housed within the article. Additionally, the front wall is provided with magnetic means in the form of a magnetic tag 3. In present illustrative case, the tag 3 comprises a magnetic marker 3*a* formed exclusively from a soft magnetic material such as, for example, permalloy and is capable of causing detectable perturbations to an applied magnetic field.

Figure 2:
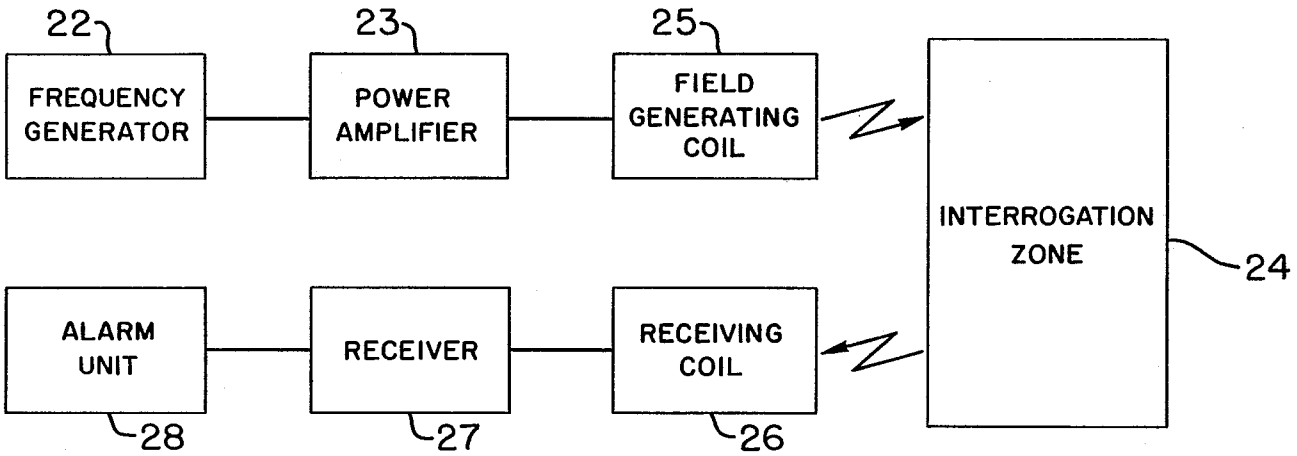
FIG. 2 illustrates an article surveillance system associated with the article enclosure of FIG. 1.

A surveillance system 21 for detecting the presence of the article 1 in an interrogation zone 24 is shown in FIG. 2. The system 21 includes a frequency generator 22 whose output is fed to a power amplifier 23 which, in turn, feeds a field generating coil 25. The latter coil establishes an alternating magnetic field of desired frequency and amplitude in the interrogation zone 24.

A receiving coil 26 senses perturbations to the magnetic field in the zone 24 and couples them to a receiver 27. The latter, in turn, provides an activating signal to an alarm unit 28 when the sensed perturbations are indicative of the magnetic tag 3 and, hence, the article 1 in the zone 24.

In accordance with the invention, the enclosure 1 for the article 2 is adapted such that when the article 2 is placed into the enclosure, the enclosure deactivates the marker 3*a* of the tag 3. In this deactivated condition, the article 2 can be taken through the interrogation zone 24 and not activate alarm unit 28.

More particularly, the enclosure 1 is provided with a magnetic means 4 in the form of a magnetized hard magnetic material. When brought adjacent the soft magnetic material of the marker 3*a*, this hard magnetic material prevents the marker from inducing detectable perturbations to the applied field in the interrogation zone 24. The magnetic means 4 is incorporated into the enclosure 1 in such a way that a magnetized surface 4′ of the magnetic means is positioned closely adjacent to the tag 3 when the article 2 is inserted in the enclosure 1.

As illustrated, the enclosure 1 comprises a bottom section 6, a top section 5 and a flexible connecting section 7 which allows pivoting the top section 5 onto the bottom section 6 once the article 2 is inserted in the enclosure. The bottom section 6 includes bottom wall 6A, front and back walls 6B and 6C and side walls 6D and 6E. Similarly, the top section includes top wall 5A, front and back walls 5B and 5C and side walls 5D and 5E.

In the present illustrative case, the front wall 6B of the bottom section 6 incorporates or has affixed to it the magnetic means 4. As a result, when the article 2 is placed in the bottom section 6 with the front wall 2*e* of the article adjacent the front wall 6B of the enclosure, the tag 3 and, thus, the marker 3*a* is brought into close proximity with the magnetized surface 4′ of the magnetic means 4. As above-indicated, the tag 3 is thereby rendered ineffective to alarm the surveillance system 21.

The enclosure 1 of the invention thus serves to itself deactivate the tag 3 of the article 2 upon the tag 3 being placed in the enclosure. No additional assembly for deactivation is thus required. Furthermore, upon removal from the enclosure, the tag 3 is automatically reactivated, thus requiring no separate reactivation means and avoiding the potential detrimental effects that inadvertent use of such a reactivation means could have on the article 2. An effective, but simple and more reliable deactivation procedure and practice is thus realized.

Figure 4:
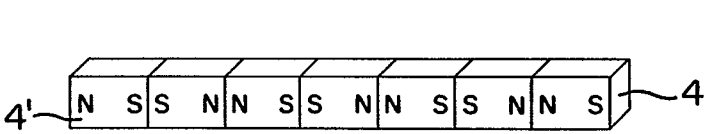
FIGS. 3 and 4 show two embodiments of the magnetic means of the enclosure of FIG. 1 in greater detail.
Figure 3:
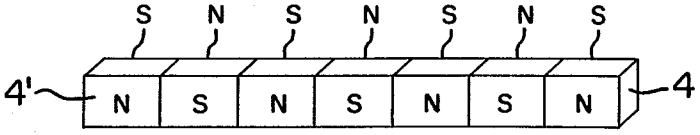

In order to ensure that the magnetic means 4 carried by the enclosure 1 affects substantially only the marker 3*a* of the tag 3 and not the magnetic tape carried by the article 2, the hard magnetic material of the magnetic means is formed such that the surface 4′ has along its length adjacent surface areas of opposite magnetic polarization. FIGS. 3 and 4 illustrate two embodiments of the magnetic means 4 which result in the aforesaid surface areas of alternating magnetic polarization.

In FIG. 3, this is realized with a thin strip of hard magnetic material having adjacent sections which are oppositely polarized in a direction perpendicular to surface 4′. In FIG. 4, a similar strip of hard magnetic material is used, however, in this case, adjacent sections are oppositely polarized in a direction parallel to the length of the surface 4′.

In both cases, oppositely polarized adjacent surface areas result. As can be appreciated, these surface areas produce a field which is sufficiently far from the surface 4′ to enter the soft magnetic marker material 3*a*′ of the tag 3 but sufficiently close to the surface 4′ so as to not otherwise disturb the tape in the article 2.

Typically, the magnetic means 4 can be formed from a flexible, extruded barium ferrite strip which is manufactured to have magnetized sections as described herein and shown in FIGS. 3 and 4. It can also be formed from individual, adjacently arranged, magnetized elements having the desired magnetic polarizations.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. Apparatus for use with an article, the article having affixed to it a magnetic marker for use in the detection of the article, the apparatus comprising:
   enclosure means for receiving and carrying the article;
   magnetic means affixed to the enclosure means for deactivating the marker of said article when said article is in said enclosure means.

2. Apparatus in accordance with claim 1 wherein:
   said magnetic marker comprises a soft magnetic material;
   and said magnetic means comprises a hard magnetic material.

3. Apparatus in accordance with claim 2 wherein:
   said hard magnetic material is permanently magnetized.

4. Apparatus in accordance with claim 3 wherein:
   said hard magnetic material is continuous and has along its length adjacent sections of opposite magnetic polarization.

5. Apparatus in accordance with claim 4 wherein:
   said hard magnetic material comprises barium ferrite.

6. Apparatus in accordance with claim 3 wherein:
said hard magnetic material comprises individual lengths of material adjacent ones of which are of opposite magnetic polarization.

7. Apparatus in accordance with claim 3 wherein:
said hard magnetic material is flexible.

8. Apparatus in accordance with claim 3 wherein:
said magnetic means is exclusive of soft magnetic material.

9. Apparatus in accordance with claim 1 wherein:
said magnetic means is affixed to said enclosure means such that said magnetic means is in adjacent relationship to said marker when said article is in said enclosure means.

10. Apparatus in accordance with claim 9 wherein:
said marker is in strip form;
said magnetic means is in strip form;
and said marker strip and said magnetic means strip are in facing relationship when said article is in said enclosure.

11. Apparatus in accordance with claim 10 wherein:
said marker strip comprises a soft magnetic material;
said magnetic means strip comprises a permanently magnetized hard magnetic material.

12. Apparatus in accordance with claim 11 wherein:
the surface of said strip of hard magnetic material closest said marker strip has along its length adjacent areas of opposite magnetic polarization.

13. Apparatus in accordance with claim 1 wherein:
said article is a magnetic tape cassette;
and said enclosure means is a case for said tape cassette.

14. Apparatus in accordance with claim 13 wherein:
said tape cassette has upper and lower walls, front and back walls and side walls;
said marker is disposed on one of said walls of said cassette;
said case has upper and lower walls, front and back walls and side walls;
and said magnetic means is disposed on the wall of said case facing said one wall of said tape cassette when said tape cassette is within said case.

15. Apparatus in accordance with claim 14 wherein:
said marker comprises a strip extending along the length of said one wall; and said magnetic means comprises a strip disposed along the length of the wall of said case facing said one wall of said tape cassette.

16. Apparatus in accordance with claim 15 wherein:
said one wall is pivotable to allow access to the tape housed within said cassette.

17. Apparatus in accordance with claim 15 wherein:
said magnetic marker strip comprises a soft magnetic material;
and said magnetic means strip comprises a permanently magnetized hard magnetic material.

18. Apparatus in accordance with claim 17 wherein:
the surface of said strip of hard magnetic material facing said marker strip has along its length adjacent areas of opposite magnetic polarization.

19. Apparatus in accordance with claim 18 wherein:
said strip of hard magnetic material comprises barium ferrite.

* * * * *